United States Patent [19]

Kadotani

[11] Patent Number: 4,823,580

[45] Date of Patent: Apr. 25, 1989

[54] WHEEL-BODY FORMING APPARATUS

[76] Inventor: Kazuo Kadotani, 28-45, Tojicho, Kokubu, Kashiwara-shi, Osaka, Pref, Japan

[21] Appl. No.: 111,303

[22] Filed: Oct. 22, 1987

[51] Int. Cl.[4] ..... B21H 1/06

[52] U.S. Cl. ..... 72/105; 72/110

[58] Field of Search ..... 72/91, 94, 105, 106, 72/107, 109, 110, 111

[56] References Cited

U.S. PATENT DOCUMENTS

| | | | |
|---|---|---|---|
| 1,720,833 | 7/1929 | Grotnes | 72/106 |
| 3,345,845 | 10/1967 | Marcovitch et al. | 72/91 |
| 3,434,322 | 3/1969 | Cowles et al. | 72/107 |
| 3,698,218 | 10/1972 | Teiting | 72/111 |
| 4,559,482 | 12/1985 | Fencl | 72/105 |

*Primary Examiner*—Lowell A. Larson
*Attorney, Agent, or Firm*—Moonray Kojima

[57] ABSTRACT

The invention relates to a wheel-body forming apparatus which is capable of forming up a high-precision wheel body having the perfect roundness, more partiuclarly, to an apparatus used for forming any of those wheel bodies such as the inner-and-outer races or pillow of bearing, or automotive gauges or sleeves for example, by applying a rolling process before eventually forming the objective material into the predetermined configuration. The apparatus related to the invention is mainly comprised of three rotative members including a shape-forming roller, a mandrel, and a supporting roller, which are respectively installed on a plane in parallel with each other. Of these, the shape-forming roller and the supporting roller are independently driven, and yet, the apparatus related to the invention is further comprised of means for numerically controlling the number of the rotation of the supporting roller relative to the number of the rotation of the shape-forming roller in accordance with the variation of the diameter of the wheel body being formed.

3 Claims, 4 Drawing Sheets

WHEEL-BODY FORMING APPARATUS

SUMMARY OF THE INVENTION

The present invention relates to an apparatus made available for forming any of those wheel bodies such as the inner-and-outer races or pillow of bearing, or automotive gauges or sleeves for example, by applying a cold rolling process before eventually forming the objective material into the predetermined configuration. The apparatus related to the invention is mainly comprised of three rotative members including a shape-forming roller, a mandrel, and a supporting roller, which are respectively installed on a plane in parallel with each other. Of these, both the shape-forming roller and the supporting roller are independently driven, and yet, the apparatus related to the invention is further comprised of means for numerically controlling the number of the rotation of the support roller relative to the number of the rotation of the shape-forming roller in accordance with the variation of the diameter of the wheel body being formed up.

BACKGROUND OF THE INVENTION

There are a variety of wheel-body forming apparatuses proposed by the prior arts including the one disclosed in the U.S. Pat. No. 3,803,890. This prior art proposes an apparatus which forms a wheel body by applying rolling process using specific constituents including four rollers which are respectively set to four positions on the external circumferential surface of a work making up the wheel body to be processed through the mandrel in the center of these rotative members to allow the objective work to be held in position in the manner of freely rotating itself while allowing the shape-forming roller to press itself against another roller before eventually forming up a complete wheel body. However, the above-cited wheel-body forming apparatus is not provided with any member corresponding to the supporting roller securely holding the mandrel. This not only causes the strength of the mandrel to lower itself when the rolling process is underway, but the apparatus itself needs to independently provide complex mechanism for stably rotating the mandrel. Furthermore, since the above-cited wheel-body forming apparatus needs to correctly regulate four positions of the external circumferential surface of the work by delicately operating four rollers, the work piece cannot fully be extended itself in the direction of the diameter, thus eventually resulting in the poor rolling efficiency, while making it difficult for the apparatus cited above to make up a work having the perfect roundness.

OBJECT OF THE INVENTION

The primary object of the invention is to overcome those problems mentioned above by providing a novel wheel-body forming apparatus which is capable of precisely processing a work piece into the one having the perfect roundness by independently driving the shape-forming roller and the supporting roller to provide the work piece with a specific rotation torque by means of the shape-forming roller and the mandrel by causing the supporting roller to rotate itself in accordance with the variation of the diameter of the work piece and the rotation of the shape-forming roller.

Another object of the invention is to provide a novel wheel-body forming apparatus which is capable of securely improving the durability of the mandrel by dispensing with slip normally occurring between the mandrel and the supporting roller by virtue of the independent driving of the shape-forming roller and the supporting roller.

Another object of the invention is to provide a novel wheel-body forming apparatus which is capable of easily controlling the number of the rotation of AC motors by merely installing an inverter between the power-supply source and the AC motors without using complex means for controlling the number of the rotation of the AC motors.

Another object of the invention is to provide a novel wheel-body forming apparatus which is provided with the extremely simplified constitution by allowing a belt to slip itself during the initial stage of the wheel-body forming process and capable of securely preventing over-current from flowing through AC motors by virtue of the slipping movement of the belt.

Another object of the invention is to provide a novel wheel-body forming apparatus which is capable of generating the predetermined rotation torque by applying a compact and light-weight oil-pressure motor and easily preventing the oil-pressure motor from incurring mechanical damage by virtue of providing the oil-pressure motor with a relief valve.

A still further object of the invention is to provide a novel wheel-body forming apparatus which is capable of precisely controlling the rotations of the rotative members by applying numerical control means event when either the mandrel or other rollers are worn out or while processing other kinds of work pieces.

Those objects mentioned above and further objects of the invention will be better understood from the following detailed description of the preferred embodiments in reference to the accompanying drawings.

DESCRIPTION OF THE PREFERRED EMBODIMENTS

Referring now more particularly to the accompanying drawings, preferred embodiments of the wheel-body forming apparatus related to the invention are described below.

(The First Preferred Embodiment)

Figure 1:
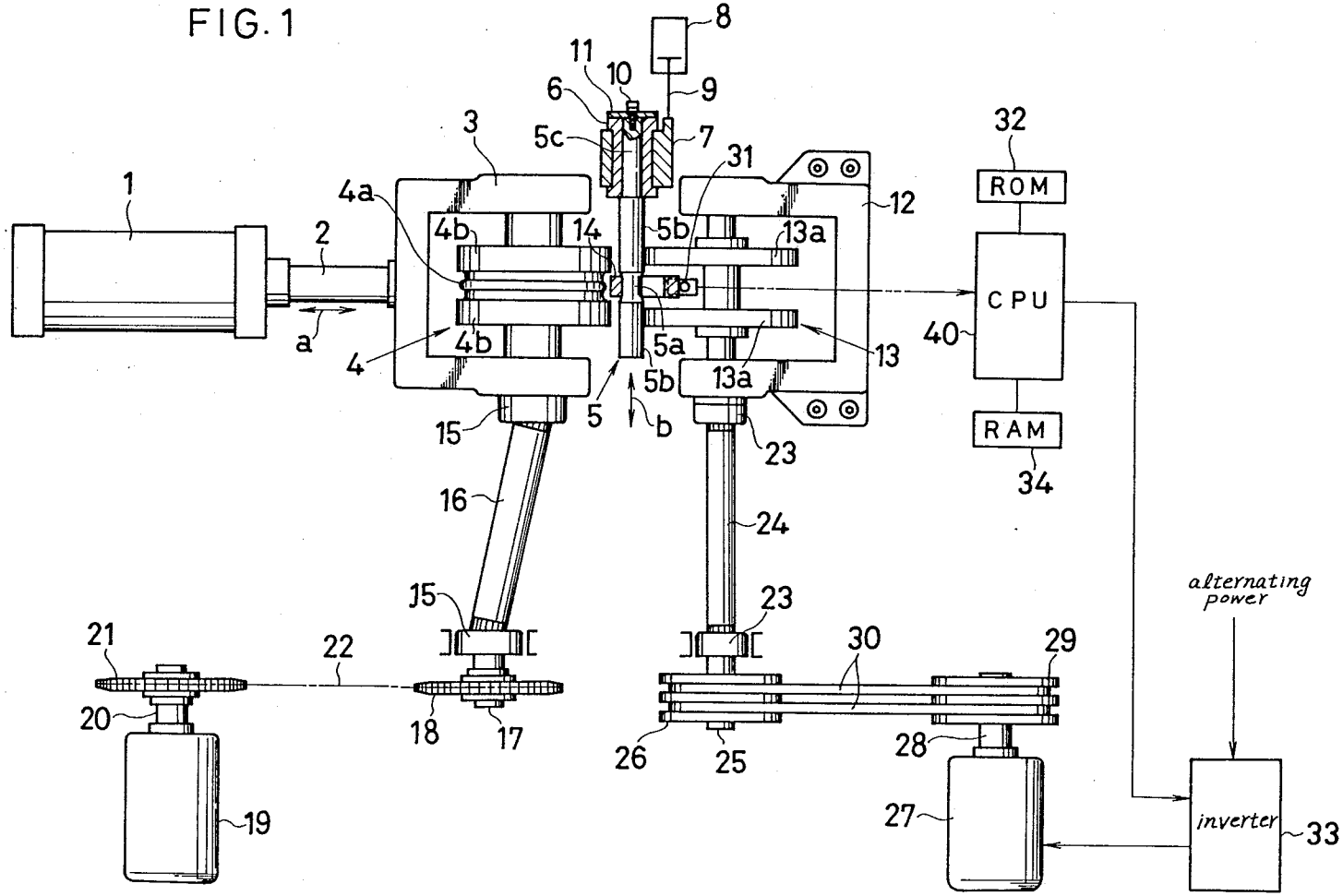
FIG. 1 is the schematic diagram of a preferred embodiment of the wheel-body forming apparatus related to the invention.

FIG. 1 is the schematic diagram of the first preferred embodiment of the wheel-body forming apparatus related to the invention. -shaped movable frame 3 having a rotative shape-forming roller 4 is installed to the tip end of piston rod 2 of the pressure cylinder 1. The shape-forming roller 4 is provided with the wheel-body forming portion 4*a* in the center of the external circumferential surface and the regulation surfaces 4*b*/4*b* on the both-side circumferential surfaces. Mandrel 5 which comes into contact with and leaves the shape-forming roller 4 is installed in order that it can travel itself in the arrowed direction b crossing the arrowed direction a, i.e., in the direction of the reciprocation of the piston rod 2, at right angle. In conjunction with wheel-body shape-forming portion 4*a* of the shape-forming roller 4, mandrel 5 is provided with wheel-body shape-forming portion 5*a* in the center of the external circumference and regulation surfaces 5*b*/5*b* on the both-side circumferential surfaces. An end of shaft 5*c* of mandrel 5 is installed to friction block 7 via metal 6 in order that the shaft end 5*c* can rotate itself. Piston rod 9 of cylinder 8 used for shifting the position of the mandrel 5 is connected to the friction block 7. The surface of shaft end 5*c* of the mandrel 5 is secured to the back plate 11 with bolt 10. Mandrel 5 can optionally be replaced with the new one by removing bolt 10. Rotative supporting roller 13 is installed to -shaped stationary frame 12. The support roller 13 is provided with contact surfaces 13*a*/13*a* in specific positions opposite from the regulation surfaces 4*b*/4*b* of the shape-forming roller 4. These contact surfaces 13*a*/13*a* respectively face the regulation surfaces 5*b*/5*b* on the back of the mandrel 5. The work piece 14 which is substantially the ring-shaped material for making up a wheel body is processed by applying a cold rolling process between the wheel-body shape-forming portion 4*a* of the shape-forming roller 4 and the wheel-body shape-forming portion 5*a* of the mandrel 5.

Figure 2:
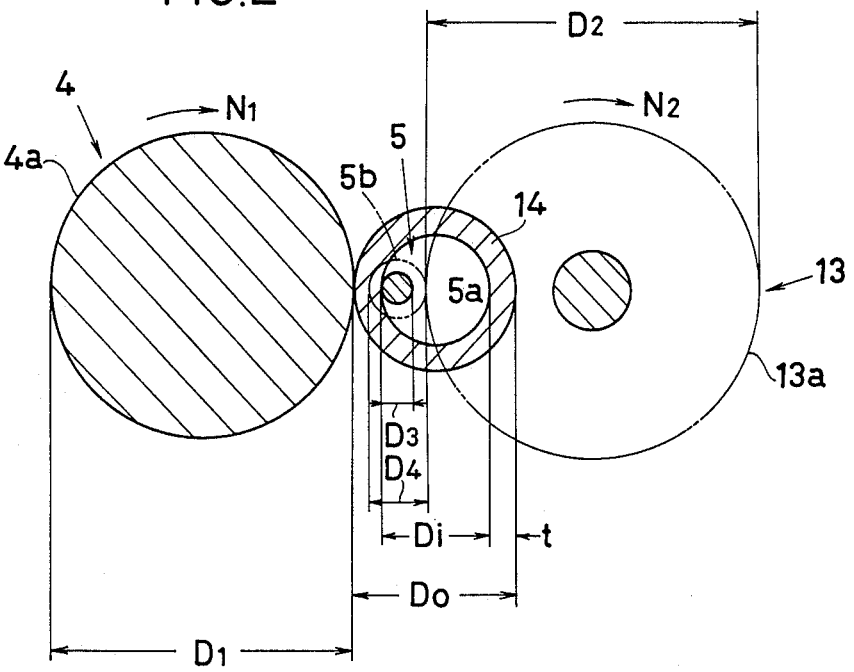
FIG. 2 is the chart denoting the relationship between three rotative members and between the diameters and the number of the rotation of the work piece related to the invention.

These rotative members including the shape-forming roller 4, mandrel 5, and the supporting roller 13 are respectively installed on the plane surface in parallel with each other as shown in FIG. 2, while these rotative members are respectively held by shaft means. Telescopic connecting shaft 16 having ball joints 15/15 on both sides is coupled to the shape-forming roller 4, while an ed of this shaft 16 is coupled to sprocket shaft 17 which is connected to input sprocket 18. The rotating shaft 20 of the first motor 19 independently driving the shape-forming roller 4 is coupled to output sprocket 21. Chain 22 which is set between the output sprocket 21 and the input sprocket 18 transmits the driving force from the first motor 19 to the shape-forming roller 4 through those constituent members 20 through 22 and 16 through 18 mentioned above in order that the shape-forming roller 4 can independently rotate itself. On the other hand, connecting shaft 24 having ball joints 23/23 on both sides is coupled to the supporting roller 13, while an end of this shaft 24 is coupled to pulley shaft 25 which is connected to input pulley 26. The rotary shaft 28 of the second motor 27 independently driving the supporting roller 13 is coupled to output pulley 29, while V-shaped belt 30 installed between the output pulley 29 and the input pulley 26 transmits the driving force from the second motor 27 to the supporting roller 13 through those constituent members 28 through 30 and 24 through 26 mentioned above in order that the supporting roller 13 can independently rotate itself.

Contact element of contact sensor 31 comes into contact with the external circumference of the work piece 14 having a specific diameter expanded by the rolling process. In response to signals input from contact sensor 31 and in accordance with programs stored in ROM 32, CPU (central processing unit) 40 properly controls the driving operations of the pressing cylinder 1, the first motor 19, the mandrel position-shifting cylinder 8, and inverter 33, respectively. Note that inverter 33 is substantially the frequency changer which allows a power-supply source having a specific frequency to generate power having an optional frequency in order that the number of the rotation of motors can freely be changed. RAM 34 stores all the data needed for executing the numerical control operations described later on. A potentiometer can be installed to the base of contact sensor 31.

Assume that the number of the rotation of the shape-forming roller 4 is N1 and the number of the rotation of the supporting roller 13 N2, respectively, then the relationship between these can be expressed by the equation shown below.

$$N2 = N1 \times \frac{D1}{D0} \times \frac{Di}{D4} \times \frac{D3}{D2}$$

where D1 denotes the diameter of the wheel-body shape-forming portion 4*a* of the shape-forming roller 4; D2 denotes the diameter of the contact surface 13*a* of the supporting roller 13; D3 denotes the diameter of the wheel-body shape-forming portion 5*a* of the mandrel 5; D4 denotes the diameter of the regulated surface 5*b* of the mandrel 5; Di denotes the internal diameter of the work piece 14; and D0 denotes the external diameter of the work piece 14, respectively.

RAM 34 stores a variety of data corresponding to N1, D1 through D4, respectively. The first preferred embodiment of the wheel-body forming apparatus related to the invention features the constitution mentioned above. Next, functional operation of the wheel-body forming apparatus reflecting the first preferred embodiment is described below.

Figure 3:
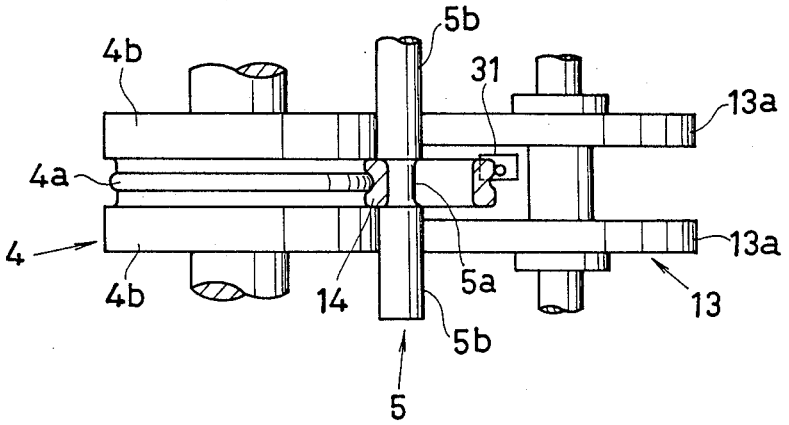
FIG. 3 is the diagram denoting the state at the time of completing the cold rolling process related to the invention.

As soon as the work piece 14 is delivered from the work-supplying unit (not shown) placed between the shapedforming roller 4 and the supporting roller 13, CPU 40 then activates the movement of the mandrel position-shifting cylinder 8 from the stand by position to the shape-forming position shown in FIG. 1. This allows the mandrel 5 to pass through he hole of the work piece 14 in order that the wheel-body shape-forming portion 5a can be delivered to a specific position exactly being opposite from the wheel-body shape-forming portion 4*a* of the shape-forming roller 4 through the work piece 14. Next, CPU 40 activates the operation of the first motor 19 to rotate the shape-forming roller 4, and simultaneously, CPU 40 also activates the operation of the second motor 27 via inverter 33 so that both the supporting roller 13 and the mandrel 5 can start to rotate themselves together. CPU 40 then activates the forward movement of the pressing cylinder 1 to shift the position of the shape-forming roller 4 unit it comes into contact with the supporting roller 13 by operating piston rod 2. This also allows the wheel-body shape-forming portion 4*a* of the shape-forming roller 4 to come into contact with the external circumference of the work piece 14. Next, when the shape-forming roller 4 is pressed, the work piece 14 is rotated by the wheel-body shape-forming portion 4*a* of the shape-forming roller 4 and the wheel-body shape-forming portion 5*a* of the mandrel 5 so that cold rolling process can be executed for the work piece 14 until it is rolled into the predetermined dimension as shown in FIG. 3.

The value of Di/D0 gradually increases itself during the rolling process from the starting time to the completion of this process before reaching a specific value close to 1 (one). CPU 40 properly controls the operation of inverter 33 in response to the work-measured signal sent from contact sensor 31, while CPU 40 simultaneously controls variable number of the rotation of the second motor 27 in accordance with an expression $N2 \approx N1 \times Di/D0$. This causes the number of the rotation N2 of the supporting roller 13 to vary itself relative to the number of the rotation of the shape-forming roller 4 in accordance with the variation of the diameter of the work piece 14. The work piece 14 receives a specific rotation torque from the shape-forming roller 4 and the mandrel 5. This allows the apparatus related to the invention to precisely form up the work piece 14 having the perfect roundness by securely preventing the work piece 14 from extending itself in the direction of tangent. Furthermore, since the first and second motors 19 and 27 respectively and independently drive the shape-forming roller 4 and the supporting roller 13, the work piece 14 receives a specific rotation torque from the shape-forming roller 4 and the mandrel 5 driven by the supporting roller 13. As a result, no slip can be generated between the mandrel 5 and the supporting roller 13, thus eventually improving the durability of the mandrel 5. Furthermore, even when the shape-forming roller 4 is worn out by repeated rolling operations or when forming a work piece having different diameters by employing different-diameter shape-forming roller, since the numbers of the rotation N1 and N2 of the shape-forming roller 4 and the supporting roller 13 vary themselves, the wheel-body forming apparatus reflecting the first preferred embodiment can fully achieve the aimed forming precision by allowing inverter 33 to preliminary set up an optional frequency by manual means for example.

Since the inverter 33 varies the power frequency (50 or 60 Hz) from 30 Hz to a maximum of 180 Hz without steps, presence of this inverter 33 between the power-supply source and the AC motors allows CPU 40 to easily control the number of the rotations of all the rotative members without performing complex operations otherwise needed for controlling the number of the rotation of those motors such as the switching of the variable-speed gears and the number of motor electrodes for example.

Furthermore, since the supporting roller 13 receives the mandrel 5, pressure-resistance strength of the mandrel 5 during the rolling process is significantly improved. In addition, since the mandrel 5 is rotated by the supporting roller 13 and the shape-forming roller 4 which respectively press themselves against both sides of the mandrel 5, the mandrel 5 can easily be driven. Since members of the work piece 14 are set in free condition except for those portions surrounded by the wheel-body forming portions 4*a* and 5*a*, the apparatus related to the invention can effectively execute the rolling operation against the work piece 14 by providing satisfactory elongation in the direction of the diameter as required. The description of the first preferred embodiment of the invention merely refers to the operation needed for forming up the outer race of bearing. However, it is also possible for the apparatus related to the invention to form a wide variety of wheel bodies by applying different mandrels and shape-forming rollers suited for processing the inner race and pillow of bearing or automotive parts like gauge and sleeve, or the like.

(The Second Preferred Embodiment)

To implement the second preferred embodiment, the wheel-forming apparatus related to the invention can dispense with contact sensor 31 and CPU 40 employed for implementing the first preferred embodiment. Instead, the second preferred embodiment allows provisions of the following: The operator can preliminary set the number of the rotation of the second motor 27 in order that it can correctly match the faster rotation number N2 of the supporting roller 13 at the moment when completing the shape-forming operation. The apparatus related to the invention then causes V-shaped belt 30 to slip itself during the initial stage of shape-forming operation in order that the slow-rotation number N2 of the supporting roller 13 can be generated during the initial stage of shape-forming operation. Finally, the controller causes the second motor 27 to be activated in order that the number of the rotation of the second motor 27 can be held constant to properly control the number of the rotation of the supporting roller 13 stepwise by effectively applying the slipping movement of V-shaped belt 30. The constitution mentioned above provides the apparatus related to the invention with simplified mechanical requirements. The apparatus related to the second preferred embodiment securely achieves satisfactory effect of the wheel-body forming identical to that of the first preferred embodiment. Furthermore, the slipping movement of V-shaped belt 30 effectively prevents overcurrent from flowing through the second motor 27.

(The Third Preferred Embodiment)

Figure 4:
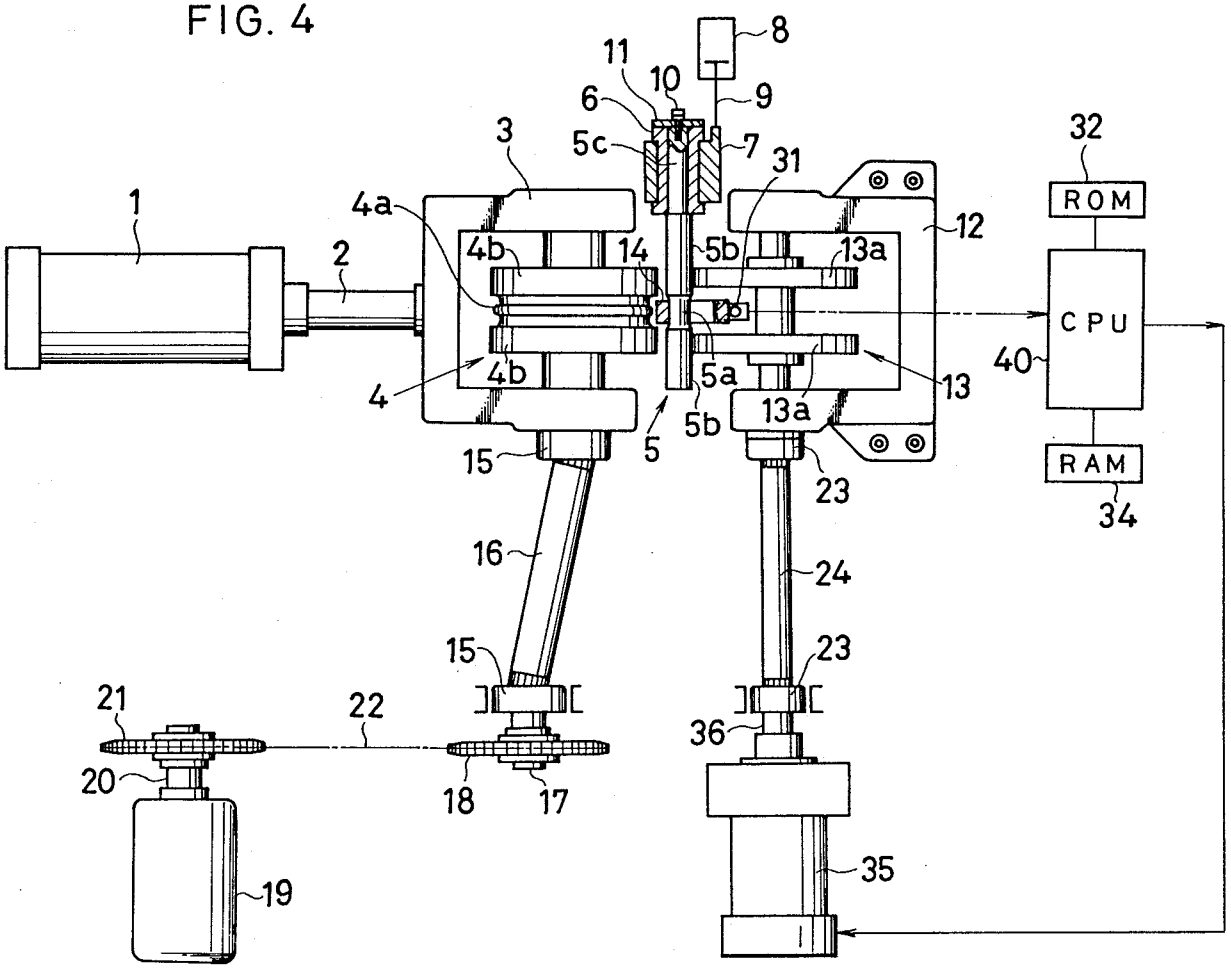
FIG. 4 is the schematic diagram of another preferred embodiment of the wheel-body forming apparatus related to the invention.

FIG. 4 denotes the third preferred embodiment of the wheel-body forming apparatus related to the invention. Output shaft 36 of oil-pressure motor 35 capable of varying the amount of waste oil is coupled to connecting shaft 24 connected to the supporting roller 13. Signal output from CPU 40 controls those factors needed for variably controlling the numbers of the rotations of those constituents including the inclined shaft and the inclined plate inside of oil-pressure motor 35. This stabilizes pressure P corresponding to torque and allows the controller to variably control only the flow rate Q corresponding to the numbers of the rotations of those rotative constituents mentioned above. By effectively driving the compact and light-weight oil-pressure motor 35 making up the second driving source, the apparatus related to the third preferred embodiment of the invention securely generates the desired rotation torque. Furthermore, this motor 35 can effectively use the oil-pressure source in common with cylinders 1 and 8, and yet, by merely adding a relief valve, the oil-pressure motor 35 can easily prevent itself from incurring mechanical damage. The constitution mentioned above allows the apparatus related to the third preferred embodiment to generate satisfactory effect of the wheel-body forming identical to that of the first preferred embodiment. Those portions shown in FIG. 4 corresponding to those which are shown in FIG. 1 are provided with identical reference numerals and symbols, while the detailed description of these are deleted.

(The Fourth Preferred Embodiment)

FIG. 4 denotes the fourth preferred embodiment of the wheel-body forming apparatus related to the invention. The apparatus shown in FIG. 5 uses the first servo motor 37 in place of the oil-pressure motor 35. Output shaft 38 of the first servo motor 37 is coupled to an end of connecting shaft 24 in order to independently transmit the driving force from the first servo motor 37 to the supporting roller 13 via the output shaft 38 and connecting shaft 24, respectively. Pressing means 39 pressing itself against the movable frame 3 causes the main gear 43 coupled to the output shaft 43 of the second servo motor 41 and the follower gear 45 coupled to screw 44 to be engaged with each other constantly. This in turn allows the driving force from the second servo motor 41 to be transmitted to screw 44 via those gears 43 and 45 to allow screw 44 to move the movable frame 3 in the forward and backward directions. Contact element of contact sensor 31 comes into contact with the external circumferential surface of the work piece 14 having a specific diameter expandable by the rolling operation. Signals from contact sensor 31 are delivered to CPU 40 via encoder 46. In response to signals from the second servo motor 41 and encoder 46 and in accordance with programs stored in ROM 32, CPU 40 properly controls operations of the mandrel position-shifting cylinder 8, the first motor 19, and the first servo motor 37. RAM 34 stores those data needed for allowing CPU 40 to execute all the control operations. In the fourth preferred embodiment, the apparatus related to the invention uses absolute-type rotary encoder 46 which encodes the value of the external circumferential surface of the work piece 14 received from contact sensor 31. By effectively incorporating those constituent members including the first motor 19 making up the first driving source, the first servo motor 37 making up the second driving source, and the second servo motor 41 making up part of shape-forming pressing means 39, the wheel-body forming apparatus reflecting the fourth preferred embodiment of the invention generates those functions described below.

The value Di/D0 gradually increases during the cold rolling process from the starting time to the completion of this process before reaching a specific value close to 1 (one). In accordance with the signal indicating the measured value of the external diameter of the work piece 14 received from contact sensor 31 and encoder 46 and also those signals indicating the amount of pressure and the amount of the delivered screw received from the second servo motor 41, CPU 40 computes the thickness "t" and the external diameter D0 of the work piece 14 to determine the value of Di/D0. CPU 40 then formulates the value of the internal diameter Di of the work piece 14 so that it corresponds to Di=D0−2t before eventually controlling the variable rotation number of the first servo motor 37 in conformity with the equation shown below.

$$N2 = N1 \times \frac{D1}{D0} \times \frac{Di}{D4} \times \frac{D3}{D2}$$

Figure 5:
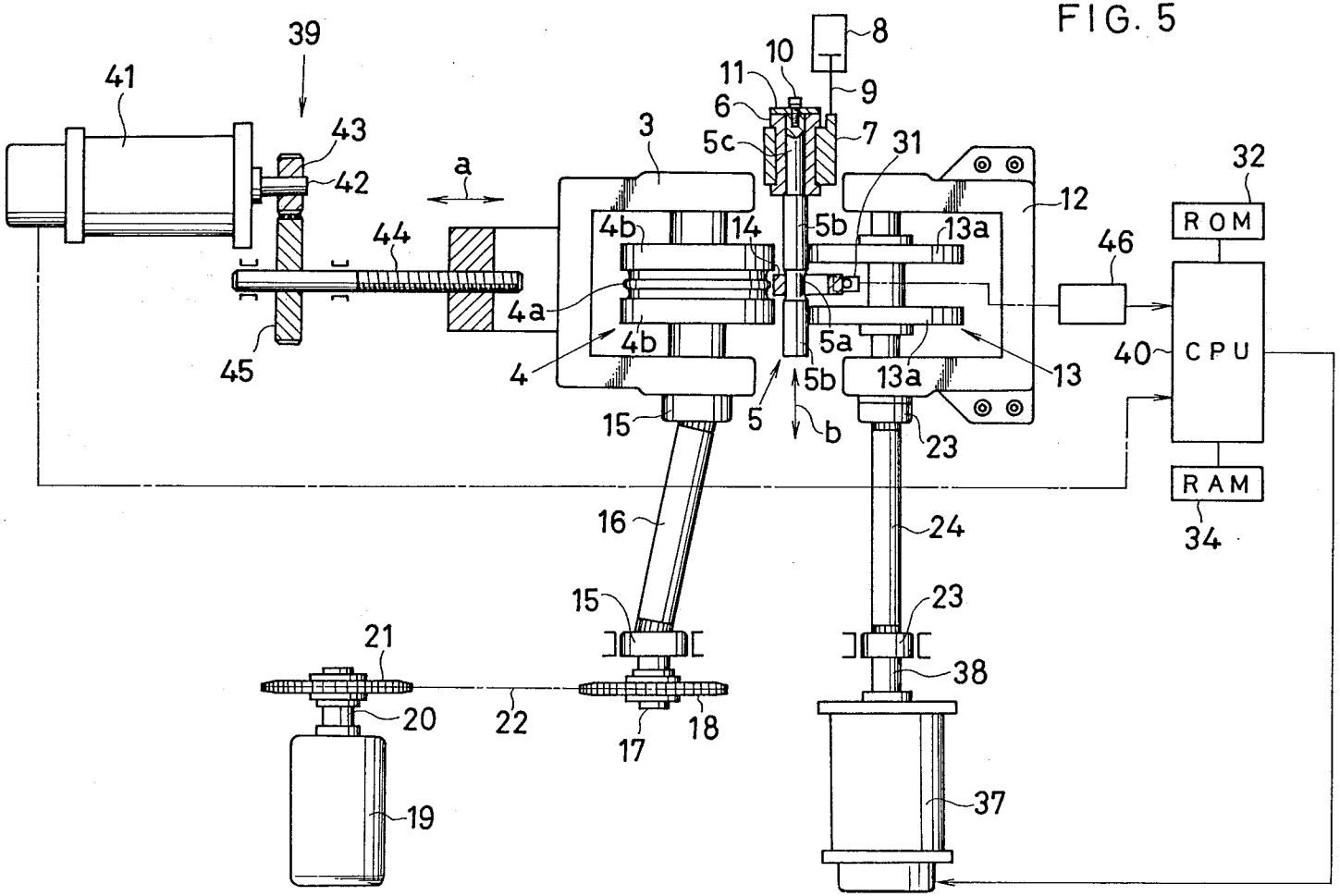
FIG. 5 is the schematic diagram of another preferred embodiment of the wheel-body forming apparatus related to the invention.

Consequently, the work piece 14 receives a specific rotation torque from the shape-forming roller 4 and the mandrel 5. CPU 40 then causes the number of the rotation N2 of the supporting roller 13 to vary itself relative to the number of the rotation N1 of the shape-forming roller 4 in response to the varying diameter of the work piece 14 until the value N2 can eventually match the equation shown above. This eventually allows the apparatus related to the fourth preferred embodiment to precisely form up the work piece having the perfect roundness by effectively preventing the work piece from expanding itself in the direction of the tangent of those rollers mentioned above. Furthermore, since the first motor 19 and the first servo motor 37 respectively and independently drive the shape-forming roller 4 and the supporting roller 13, the work piece 14 receives a specific rotation torque from the shape-forming roller 4 and the mandrel 5 driven by the supporting roller 13. As a result, no slip can be generated between the mandrel 5 and the supporting roller 13, thus eventually improving the durability of mandrel 5 itself. Furthermore, even when the shape-forming roller 4 is worn out by repeated rolling operations or when forming a special work piece having different diameters by employing a different-diameter shape-forming roller, since the numbers of the rotation N1 and N2 of the shape-forming roller 4 and the supporting roller 13 are respectively variable by NC (numerical control) means in conjunction with the equation shown above, the wheel-body forming apparatus reflecting the fourth preferred embodiment can precisely form up the objective work piece. In addition, by virtue of negligible amount of inertia and satisfactory follow-up characteristic, the first and second servo motors 37 and 41 precisely control the numbers of the rotations of those rotative constituents mentioned above. In particular, numerical control means mentioned above is substantially of absolute type capable of correctly memorizing the origin positions of the movable constituents themselves needed for making up the origin of programs to be executed, and thus, even if the power-supply source were provisionally cut off, the numerical control system correctly follows up numerical control operations after resumption of the power supply service. This in turn allows operators to easily replace the rotative constituents of the apparatus shown in FIG. 5 as required. Note that those constituents of the apparatus shown in FIG. 5 are provided with reference numerals and symbols identical to those which are shown in FIGS. 1 and 4.

It is also possible for the fourth preferred embodiment of the apparatus related to the invention to use a servo motor in place of the first motor 19 to permit the controller to variably control the numbers of the rotation N1 and N2 in order that the numerical control system can more precisely implement control operations. It is recommended that ball screws be made available for screw 44.

The wheel-body forming apparatus related to the invention may also be used for removing deflected part from the forged wheel body and also for expanding the diameter of the pressed wheel body as well. Needless to say that both ends of the mandrel 5 are properly held throughout the rotating operations of all of those rotative constituents of the wheel body forming apparatus related to the invention.

While only certain embodiments of the invention have been described, it will be apparent to those skilled in the art that various changes and modifications may be made. However, such variations are not to be regarded as a departure from the spirit and scope of the invention, but all such modifications are included within the scope of the following claims.

What is claimed is:

1. A wheel body forming apparatus comprising an extended shape forming cylindrical roller comprising a wheel body forming part at the middle of a lateral external circumferential surface;

an extended cylindrical mandrel positioned on one side of and parallel to said shape forming roller and movable to be contactable with said shape forming roller, said mandrel comprising a wheel body forming portion at the middle of a lateral external circumferential surface and a regulation surface on circumferential surfaces on both lateral sides of said body forming portion;

an extended supporting cylindrical roller positioned parallel to and on a side of said mandrel opposite to said shape forming roller, said supporting roller having an external circumferential surface contactable with said regulation surface of said mandrel;

first drive means for rotating said shape forming roller;

second drive means for independently driving said supporting roller;

sensor means for generating signals indicative of a ratio of the inner diameter and outer diameter of said work piece, said sensor means comprising a sensor device disposed to be in contact with the outer circumferential surface of said wheel body being worked by said mandrel and said shape forming roller for continuously measuring the variations in the outer diameter of said wheel body being worked, memory means for storing information related to desired inner and outer diameters of said wheel body, and means for obtaining the ratio of inner and outer diameters based on the measurement of the outer diameter by said sensor device; and control means responsive to said signals from said sensor means for controlling the second driving means so that the number of rotations per unit time of said supporting roller is controlled to be substantially equal to the number of rotations per unit time of said shape forming roller multiplied by the ratio of said inner diameter of said wheel body being worked to said outer diameter of said wheel body being worked.

2. The apparatus of claim 1, wherein said first drive means comprises a first motor, and said second drive means comprises a second, oil pressure motor.

3. The apparatus of claim 1, wherein said control means comprises a central processing unit and an inverter.

* * * * *